United States Patent [19]

Berthold et al.

[11] Patent Number: 5,006,440

[45] Date of Patent: Apr. 9, 1991

[54] PROCESS FOR STABILIZING PHOTOGRAPHIC SILVER IMAGES

[75] Inventors: Werner Berthold, Leverkusen; Hans Öhlschläger, Bergisch Gladbach, both of Fed. Rep. of Germany

[73] Assignee: Agfa Gevaert Aktiengesellschaft, Leverkusen, Fed. Rep. of Germany

[21] Appl. No.: 586,515

[22] Filed: Sep. 21, 1990

[51] Int. Cl.[5] ..... G03C 5/24

[52] U.S. Cl. ..... 430/429; 430/372; 430/428; 430/463

[58] Field of Search ..... 430/372, 428, 429, 463, 430/490

[56] References Cited

U.S. PATENT DOCUMENTS 4,855,217 8/1989 Kuramatou et al. ..... 430/372

4,960,683 10/1990 Okazaki et al. ..... 430/428

FOREIGN PATENT DOCUMENTS 201056 11/1984 Japan ..... 430/429

*Primary Examiner*—Hoa V. Le

*Attorney, Agent, or Firm*—Connolly and Hutz

[57] ABSTRACT

A silver image produced by imagewise exposure, development and fixing of a photographic material containing at least one silver halide emulsion layer is stabilized by being subjected after fixing to treatment by a stabilizing bath containing a compound corresponding to general formula I $$R_1-(NHCO-R_2-R_3)_m \quad (I)$$

in which $R_1$ represents a nitrogen-containing 5- or 6-membered heterocycle, $R_2$ represents an optionally branched $C_{1-8}$ alkylene radical, $R_3$ represents Cl or Br and m = 1 or 2.

2 Claims, No Drawings

PROCESS FOR STABILIZING PHOTOGRAPHIC SILVER IMAGES

This invention relates to a process for stabilizing photographic silver images by treatment with a stabilizing bath.

In photographic processing, the unexposed silver halide is normally complexed with alkali or ammonium thiosulfates after development and removed more or less thoroughly by subsequent washing. The completeness with which the silver thiosulfate complexes are removed depends on the duration and temperature of this treatment step and on the support used for the photographic layer which may be, for example, baryta paper, polyethylene-laminated paper, cellulose acetate film or polyester film. On average, washing for 30 minutes at around 25.C is necessary, although thiosulfate residues can still be left behind. In this case, the silver images can become patchy in the event of storage, gradually changing color either completely or locally from black to brown or yellow. The reason for this is the formation of silver sulfide which can form through decomposition of the residual thiosulfate.

Photographic silver images undergo similar troublesome discoloration on exposure to oxidizing gases. The oxidation of the silver image causes the formation of water-soluble silver salts which can diffuse in the material. Photolysis of these soluble silver salts results in the formation of finely divided, yellow to red-brown colored colloidal silver or in the formation of brown-colored silver compounds. In many cases, these troublesome changes can occur in the final photographic silver image in the form of so-called microspot defects.

There has been no shortage of attempts to avoid or reduce these troublesome subsequent changes in the photographically produced silver images, for example by more thoroughly washing out the chemicals required for processing of the exposed photographic recording materials or by storing the processed recording materials, i.e. the final silver images, under standardized atmospheric conditions.

Various processes have been prescribed with a view to shortening the washing time and eliminating the adverse effects of the thiosulfate impurities. One useful method of converting residual thiosulfate into photographically harmless compounds is to use monochlorine and monobromine compounds, such as chloroacetic acid, in accordance with DE-A-1 522 428. In an after-treatment bath containing the above-mentioned monochlorine or monobromine compound, which follows the shortened washing step, the thiosulfates are converted into the corresponding salt of a thiosulfuric acid S ester, the so-called Bunte salt.

These compounds are no longer capable of reacting like thiosulfates with the image silver itself. However, the washing step carried out after fixing cannot be completely eliminated as long as baryta paper or other papers with no plastic coating are used as supports. By contrast, there is no need at all for final washing if the support used for the photographic layer is a plastic-coated paper, such as polyethylene-coated paper, or acetyl cellulose in the case of film.

Various classes of compounds for stabilizing silver images have been described with a view to counteracting harmful environmental influences in the form of oxidizing gases, generally being used in additional finishing baths after the final washing bath, i.e. after complete removal of the thiosulfate.

Compounds such as these include non-cyclic or cyclic thiosemicarbazides (DE-A-20 00 622), heterocyclic mercapto or thione compounds from the group consisting of tetrahydropyrimidines, thiazines or tetrazines (DE-A-20 13 423), organic and inorganic thiocyanates (DE-A-22 18 387), isothioureas (US-A-4,500,632) and 5-aminotetrazole and mercaptotetrahydrotriazines (DE-A-37 33 291). Unfortunately, these compounds do not satisfy practical requirements because their stabilizing effect is inadequate.

In other known processes, the stabilizing additives are directly incorporated in the photographic silver halide material. Thus, DE-A-31 51 182 (GB-A-2,090,991) describes the incorporation of polyvinyl imidazole while GB-A-1,156, 167 describes the incorporation of sulfoalkyl-substituted hydroquinones.

However, relatively high concentrations of 0.5 $g/m^2$ have to be used to obtain adequate stabilization. The compatibility of polyvinyl imidazole with silver halide emulsions, with wetting agents, stabilizers, developers and auxiliary developers is extremely critical. In addition, high concentrations in the protective layer lead to a reduction in gloss.

It has now been found that photographic silver images can be stabilized by a process which eliminates the disadvantages mentioned above and in which there is no need for washing after fixing and in which only one compound and only one bath which protects the silver image both against discoloration by thiosulfate decomposition and against discoloration by oxidizing gases is used for stabilization.

The present invention relates to a process for stabilizing a silver image produced by imagewise exposure, development and fixing of a photographic material containing at least one silver halide emulsion layer, characterized in that, after fixing, the photographic material is subjected to the treatment by a stabilizing bath which contains a compound corresponding to general formula I $$R_1\text{—}(NHCO\text{—}R_2\text{—}R_3)_m \qquad (I)$$

in which $R_1$ represents a nitrogen-containing 5- or 6-membered heterocycle, $R_2$ represents an optionally branched $C_{1-8}$ alkylene radical, $R_3$ represents Cl or Br and m = 1 or 2.

The nitrogen heterocycles may be substituted, for example, by $C_{1-4}$ alkyl radicals.

The following compounds, for example, are suitable:

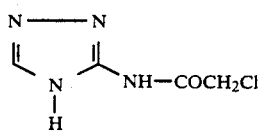

1

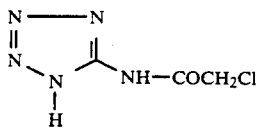

2

-continued

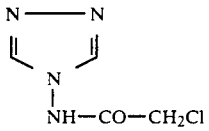

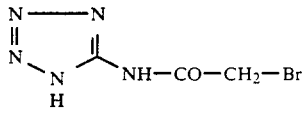

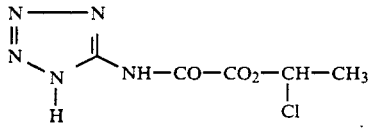

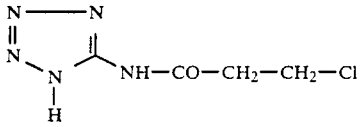

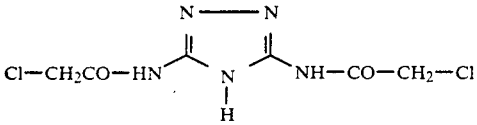

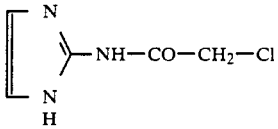

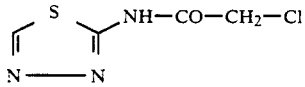

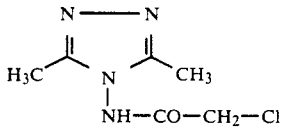

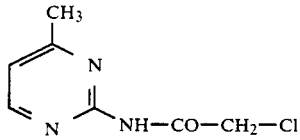

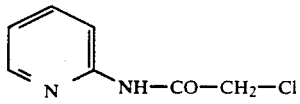

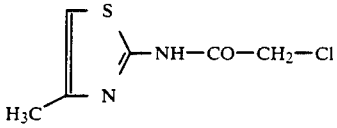

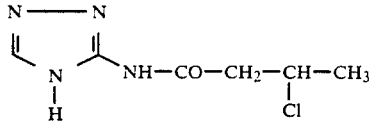

The compounds corresponding to formula I may readily be obtained by methods known from the literature by reaction of a heterocyclic amine with a halocarboxylic acid chloride or a halocarboxylic anhydride, preferably in a solvent, such as acetone or pyridine.

Washing may be carried out between fixing and the stabilizing bath according to the invention, although it is not necessary.

In the most simple case, the stabilizing bath according to the invention consists of a solution of the stabilizing compounds. Although aqueous solutions are preferred, solutions in organic solvents or in solvent mixtures of water and organic solvents, such as aliphatic alcohols, dimethyl formamide or the like, may also be used.

To improve the solubility of aqueous solutions, the pH value of the solution may be raised or lowered, for example with KOH or with $H_2SO_4$.

The concentration of the compound used in the stabilizing bath is in the range from 0.5 to 100 g/l and preferably in the range from 10 to 50 g/l.

The process according to the invention may be used for all photographic silver images, irrespective of the particular method used for their production. For example, silver images conventionally produced by development and fixing of an exposed photographic material may be stabilized. The silver images may be in the form of typical half-tone images, copies from the graphic field or films.

Finished silver images, i.e. silver images produced photographically by development or activation of a photographic recording material containing exposed silver halide, are subjected to the stabilizing process according to the invention, the processing cycle after the development step comprising a treatment step in which the unexposed silver halide is removed.

This treatment step may comprise, for example, subjecting the developed photographic recording material already containing the silver image, but also residual silver halide, to a typical fixing treatment, for example in a processing bath containing an alkali thiosulfate or ammonium thiosulfate, the silver halide being dissolved out of the recording material in the form of a soluble silver complex salt.

The aftertreatment bath according to the invention may contain other additives, such as wetting agents, pH-modifying agents and antioxidants, for example an alkali metal sulfite or a hydroxyl amine salt.

The photographic silver image is stabilized by the aftertreatment bath according to the invention so that it is substantially unaffected by external influences, particularly oxidizing gases, during subsequent storage. The onset of the stabilizing effect is also largely dependent on the particular type of photographic recording material used to produce the silver image providing it contains at least one photosensitive silver halide emulsion layer and is developed by a black-and-white development process.

The photosensitive silver halide emulsions present in the recording material may contain as halide chloride, bromide or iodide and mixtures thereof. In one preferred embodiment, 0 to 12 mol-% of the halide of at least one layer may consist of iodide, 0 to 50 mol-% of chloride and 50 to 100 mol-% of bromide. The silver halide may consist of predominantly compact crystals which may have, for example, a regular cubic or octahedral form or transitional forms. They may be characterized in that they essentially have a thickness of more than 0.2 μm. The average diameter-to-thickness ratio is preferably below 8:1, the diameter of a crystal being defined as the diameter of a circle with an area corresponding to the projected area of the crystal. In another preferred embodiment, however, all the emulsions or individual emulsions may also contain substantially platy silver halide crystals in which the diameter-to-thickness ratio is considerably greater than 8:1. The emulsions may be monodisperse or heterodisperse emulsions which preferably have a grain size of 0.3 μm to 1.2 μm. The silver halide crystals may have a layered structure.

Suitable protective colloids or binders for the layers of the recording material are the usual film-forming agents, for example proteins, particularly gelatine. However, the gelatine may be completely or partly replaced by other natural or synthetic binders. Casting aids and plasticizers may be used, cf. Research Disclosure 17 643 (December, 1978), more particularly Chapters IX, XI and XII.

The emulsions may be chemically and/or spectrally sensitized in the usual way. They may contain silver halide stabilizers and the emulion layers and other non-photosensitive layers may be hardened in the usual way with known hardeners. Suitable chemical sensitizers, spectral sensitizers, stabilizers and hardeners are described, for example, in Research Disclosure 17 643, cf. in particular Chapters III, IV, VI and X.

The recording materials subjected to the stabilizing process according to the invention are exposed to form an image, ultraviolet light, visible light or infrared light or even high-energy radiation being used for exposure. Exposure is followed by typical processing to convert the exposed silver halide into image silver, for which purpose the recording material is treated in the presence of a silver halide developing compound which may be present in one of the layers of the recording material or in an aqueous treatment bath, generally in an alkaline medium. Inorganic or organic developer compounds may be used, including for example hydroquinone, 3-pyrazolidone, aminophenol and derivatives thereof, cf. Research Disclosure 17 643, Chapter XX. In general, development is followed by treatment in a fixing bath in which the unexposed and undeveloped silver halide is dissolved out of the recording material.

The stabilizing process according to the invention is most effective when it is applied as the final treatment step before drying of the black-and-white image. This also means that, preferably, the stabilizing bath according to the invention is not followed by any other liquid treatment, more particularly washing. However, the stabilizing bath according to the invention may be followed by brief washing to reduce the surface concentration of salts from the stabilizing bath in order to improve gloss.

EXAMPLES

Samples in the form of grey step wedges of polyethylene-coated black-and-white papers based on silver bromide containing 1.5 g $AgNO_3$ per $m^2$ were developed for 60 s at room temperature in a black-and-white phenidone/hydroquinone paper developer, subsequently treated for 30 s in a stop bath consisting of 2% by weight acetic acid and then fixed for 5 minutes in a fixing bath based on ammonium thiosulfate.

Comparison samples (Examples 1 and 2) were then washed for 15 minutes in running water, the thiosulfate being completely removed. The samples were then either dried (Example 1) or additionally aftertreated in a bath containing substances which protect the silver image against the effect of oxidizing gases, for example 5-aminotetrazole (Example 2).

In contrast to the preceding samples, another comparison (Example 3) was only stripped after fixing and not washed, but instead treated for 3 minutes in a 1% by weight aqueous solution of the sodium salt of monochloroacetic acid, stripped and dried without further washing.

The samples processed in accordance with the invention (Examples 4 to 17) were also not washed after fixing, stripped and placed for 3 minutes in a bath containing one of the compounds according to the invention in various concentrations. The samples were then stripped and dried.

The samples processed in accordance with the invention were tested for residual thiosulfate; after 4 days, little or no residues of thiosulfate were present.

All the samples were tested for their resistence to the effect of oxidizing gases, in the present case peroxides. To this end, the samples were hung up in a closed, aquarium-like vessel which stands in daylight at room temperature and which contains dishes filled with 3% by weight hydrogen peroxide distributed over its base. Instead of hydrogen peroxide, solid sodium percarbonate may also be used providing at the same time a relative air humidity of 84% is established with saturated potassium bromide solution. However, it takes much longer in this case for the silver image to be attacked and for differences to be observed.

The series of samples was stored for 5 days over liquid hydrogen peroxide and then evaluated. The test was carried out under the following conditions:

| | |
|---|---|
| volume of the aquarium | approx. 20 l |
| quantity of the $H_2O_2$ solution | 150 ml |
| potassium bromide solution | 100 ml |
| quantity of material | 2,500 $cm^2$ |

TABLE 1

| Example | Aftertreatment compound | Concentration (% by weight) | Solubility at pH | Silver salt stability | Destruction of fixing bath |
|---|---|---|---|---|---|
| 1 | — | | — | 6 | —*** |
| 2 | * | 3 | — | 2 | —*** |
| 3 | ** | 4 | — | 6 | 1 |
| 4 | 1 | 2 | 13 | 1-2 | 2 |
| 5 | 1 | 4 | 13 | 1-2 | 2 |
| 6 | 2 | 2 | 13 | 2-3 | 1 |
| 7 | 2 | 4 | 13 | 1-2 | 1 |
| 8 | 3 | 2 | 13 | 2 | 1 |
| 9 | 3 | 4 | 13 | 1-2 | 1 |
| 10 | 4 | 2 | 11 | 1 | 2 |
| 11 | 4 | 4 | 11 | 1 | 3 |
| 12 | 5 | 2 | 11 | 1-2 | 3 |

TABLE 1-continued

| Example | Aftertreatment compound | Concentration (% by weight) | Solubility at pH | Silver salt stability | Destruction of fixing bath |
|---|---|---|---|---|---|
| 13 | 5 | 4 | 11 | 1-2 | 2 |
| 14 | 7 | 2 | 11 | 1 | 1 |
| 15 | 7 | 4 | 11 | 1 | 1 |
| 16 | 8 | 2 | 13 | 1-2 | 1 |
| 17 | 8 | 4 | 13 | 1 | 1 |

*5-Aminotetrazole
**Monochloroacetic acid
***Since the samples were additionally washed in these test, destruction of the fixing bath does not apply.

Explanation of the marking of silver image stability:
1 = silver image unchanged
2 = image locally discolored to light brown or incipient fading
3 = image locally discolored to dark brown
4 = image locally faded
5 = image destroyed through fading or discoloration Explanation of marking of fixing bath destruction:
1 = thiosulfate completely destroyed
2 = traces of residual thiosulfate still present
3 = distinct residues of thiosulfate still present
4 = considerable quantities of thiosulfate still present
5 = hardly any thiosulfate destroyed
6 = all the thiosulfate still present Although Example 2 according to the prior art shows good values, the use of 5-aminotetrazole, in contrast to the invention, does require thorough washing beforehand (DE-A-37 33 291).

We claim:

1. A process for stabilizing a silver image produced by imagewise exposure, development and fixing of a photographic material containing at least one silver halide emulsion layer, characterized in that, after fixing, the photographic material is subjected to the treatment by a stabilizing bath which contains a compound corresponding to general formula I $$R_1—(NHCO—R_2—R_3)_m \quad (I)$$

in which $R_1$ represents a nitrogen-containing 5- or 6-membered heterocycle, $R_2$ represents a straight or branched $C_{1-8}$ alkylene radical, $R_3$ represents Cl or Br and m = 1 or 2.

2. A process as claimed in claim 1, characterized in that the stabilizing bath contains compound I in a quantity of 0.5 to 100 g/l.

* * * * *